United States Patent [19]

Roggow et al.

[11] 4,256,059

[45] Mar. 17, 1981

[54] HEAT-EXCHANGING SYSTEM

[75] Inventors: Mervin A. Roggow, Carlos; J. Harold Stiver, Alexandria, both of Minn.

[73] Assignee: Energy Concerns, Inc., Alexandria, Minn.

[21] Appl. No.: 37,663

[22] Filed: May 10, 1979

[51] Int. Cl.[3] ..... F22B 1/02; F25B 27/02

[52] U.S. Cl. ..... 122/32; 62/238.6

[58] Field of Search ..... 62/238 E, 324 D; 122/32, 77, 53, 100, 118, 122, 127, 131, 140 A, 155 C; 165/137, 39, 164

[56] References Cited

U.S. PATENT DOCUMENTS

| | | | |
|---|---|---|---|
| 1,761,553 | 6/1930 | Whitney . | |
| 1,786,861 | 12/1930 | Miller et al. . | |
| 2,125,842 | 8/1938 | Eggleston | 62/238 E |
| 2,516,094 | 7/1950 | Ruff | 62/238 E |
| 2,562,651 | 7/1951 | Whitney . | |
| 2,632,306 | 3/1953 | Ruff | 62/238 E |
| 2,700,279 | 1/1955 | Stickel | 62/238 E |
| 3,759,230 | 9/1973 | Cooksley | 122/155 C |
| 3,922,876 | 12/1975 | Wetherington, Jr. et al. | 62/180 |
| 3,994,142 | 11/1976 | Kramer | 62/117 |
| 4,041,724 | 8/1977 | Gustafsson | 62/175 |
| 4,041,726 | 8/1977 | Mueller et al. | 62/238 E |
| 4,146,089 | 3/1979 | Meuller et al. | 62/238 E |
| 4,148,355 | 4/1979 | Gehring | 62/238 E |
| 4,168,745 | 9/1979 | Lastinger | 62/238 E |
| 4,173,872 | 11/1979 | Amthor, Jr. | 62/238 E |

OTHER PUBLICATIONS

"How Heat Exchangers Work" by R. A. Peterson, p. 18, *Dairy Herd Mgt.* Jan. 1978 Issue.

*Primary Examiner*—Lloyd L. King

*Attorney, Agent, or Firm*—Schroeder, Siegfried, Ryan, Vidas, Steffey & Arrett

[57] ABSTRACT

A heat-exchanging system having an upright water tube in a water tank with an open upper end and connected at each end to a surrounding tube of larger diameter which forms a spaced jacket therearound and a centrally arranged tube connected at its lower end to the discharge of a compressor of a refrigerating system and extending upwardly within the water tube and connected at its upper end with the space between the water tube and its surrounding tube. The latter has an outlet connected to the return inlet of the condenser and hence the compressor of the refrigerating system. The water tank has a hot water outlet at its upper end connected with the supply inlet of a conventional hot water heater, and a cold water outlet adjacent its lower end, the latter being connected to the inlet of the water tube and to a source of pressurized cold water.

8 Claims, 3 Drawing Figures

HEAT-EXCHANGING SYSTEM

This invention relates to heat-exchangers. More particularly, it relates to a novel heat-exchanging system for use in utilizing to advantage the heat generated by a compressor of a refrigerating system to preheat the water supplied to a conventional water heater and at the same time, cool the condensed refrigerant before conveying the same to the condenser of the refrigerating system, thereby causing the latter to operate more efficiently.

It is a general object of our invention to provide a novel and improved heat-exchanger of simple and inexpensive construction and installation.

A more specific object is to provide a novel and improved heat-exchanging system which functions efficiently and is very simple and inexpensive to manufacture and install.

Another object is to provide a novel and improved heat-exchanging system which functions in a more efficient manner.

Another object is to provide a novel and improved heat-exchanging system which will reduce the amount of fuel needed to maintain a supply of hot water in a hot water tank and at the same time, cause the refrigerating system to operate more efficiently and which requires a minimum of space and is simple and easy to install and manufacture.

These and other objects and advantages of our invention will more fully appear from the following description, made in connection with the accompanying drawings, wherein like reference characters refer to the same or similar parts throughout the several views, in which.

Figure 1:
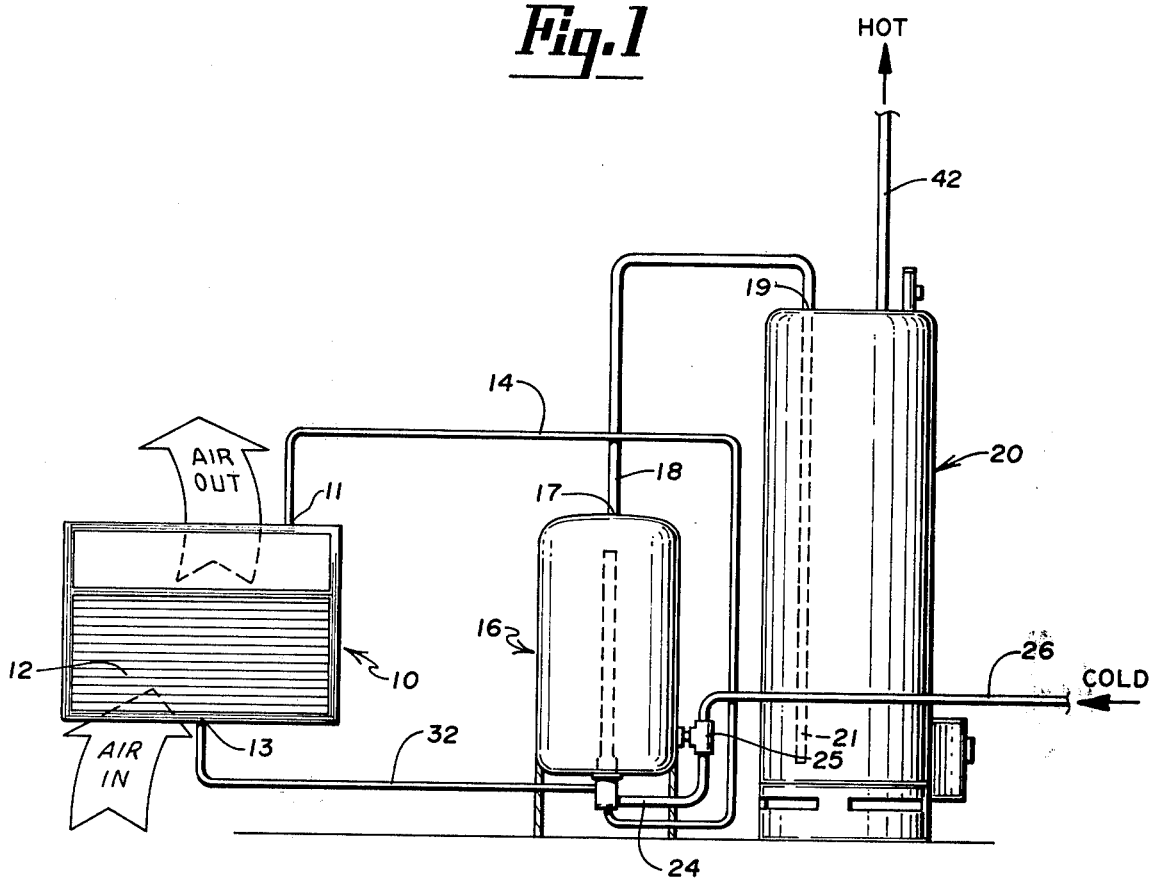
FIG. 1 is a schematic diagrammatical view of our novel heat-exchanging system.

FIG. 1 is a schematic diagrammatical view of our heat-exchanging system which, as shown, includes a refrigeration system identified generally by the numeral 10 and which may be comprised of a conventional air conditioning system, or a refrigerator, either of which includes a compressor (not shown) that compresses the refrigerant and discharges the same from a discharge port which has been indicated generally by the numeral 11. Conventionally, either the refrigerator or air conditioner will include a condenser identified by the numeral 12, the normal purpose of which is to cool the refrigerant before it enters the cooling coils (not shown) in which the refrigerant expands and returns to gaseous form, thereby absorbing heat from the coil surroundings. The inlet to the condenser has been designated by the numeral 13.

Figure 3:
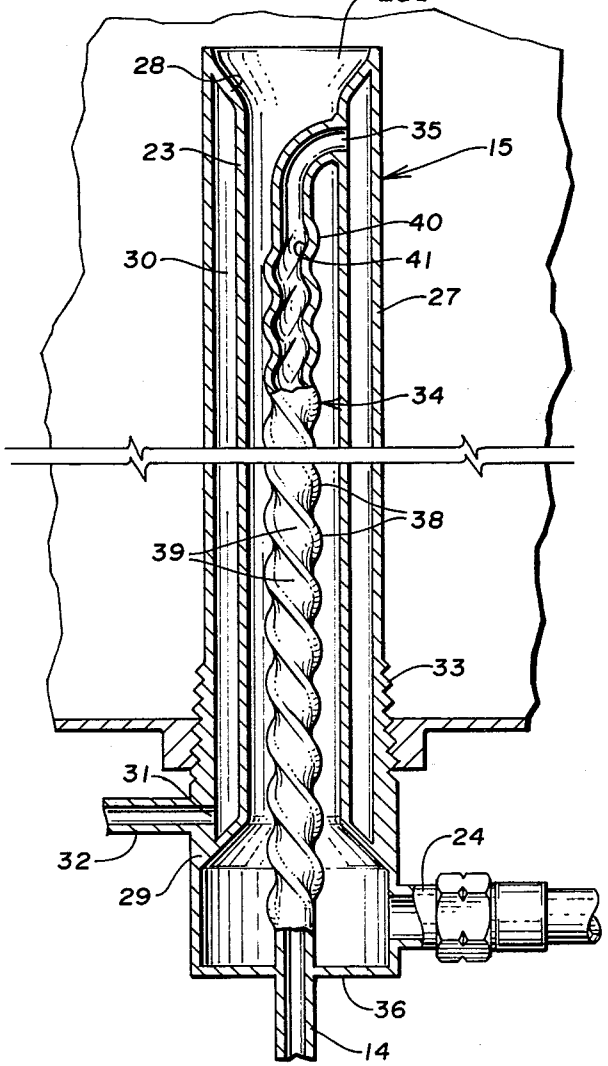
FIG. 3 is a vertical sectional view of an enlarged scale of our novel heat-exchanger.

A hot liquid refrigerant line or conduit 14 extends to the heat-exchanger, which has been indicated generally by the numeral 15 in FIG. 3. As shown, this heat-exchanger is mounted upon the bottom of a storage water tank 16 which has a hot water outlet 17 at its upper end connected by a conduit 18 to the supply inlet 19 of a conventional hot water heater 20, the conduit 18 terminating slightly above the bottom of the heater 20, as indicated at 21.

Figure 2:
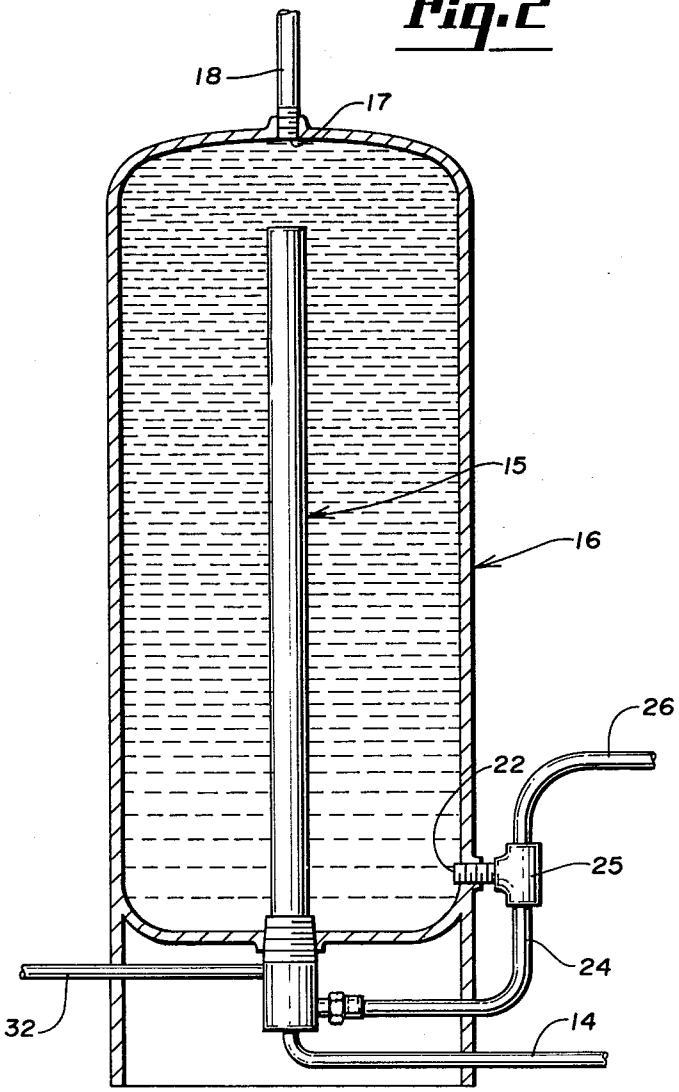
FIG. 2 is a vertical sectional view of a water storage tank with one of our heat-exchangers installed therewithin.

FIGS. 2 and 3 show the details of construction of our heat-exchanger and its mounting and connections with the refrigerating system 10 and the water storage tank 20. As shown, the water tank 16 has a cold water outlet 22 adjacent its lower end and is provided with an upstanding water tube or conduit 23 which has an open upper end 23*a* and is connected at its lower end to the cold water outlet 22 of the tank 16 by a conduit 24. By a T-connection 25, the conduit 24 and the cold water outlet 22 are each connected to a pressurized cold water supply 26.

The water tube or conduit 23 is surrounded by a second tube 27 of larger diameter and is joined and sealed thereto at its upper end as at 28, and at its lower end as at 29. Thus, the outer tube 27 forms a jacket which surrounds the water tube 28 and provides an annular chamber 30 therearound. The jacket 27 is provided with a discharge port 31 to which a conduit 32 is connected to convey the cooled refrigerant back to the inlet port 13 of the condenser 12. The lower exterior portions of the tube 27 is threaded as at 33 to facilitate installment in the bottom of the tank 16.

Extending upwardly within the central portion of the water tube 23 is a hot refrigerant conduit 34 which is connected at its upper end with the space between the water tube 23 and the outer conduit 27 as at 35. This refrigerant conduit 34 is connected at its lower end to the lower end of the tube 23 as at 36 so as to close off the lower end of the tube 23. This permits connection of the conduit 34 with the conduit 14 which connects the former with the discharge outlet 11 of the compressor so as to receive the hot condensed refrigerant therefrom and convey the same upwardly within the tube 34. It moves downwardly within the annular chamber 30 to be discharged through the discharge port 31, and returned via conduit 32 to the inlet 13 of the condenser 12. The hot refrigerant tube or conduit 34 is characterized by its configuration which, as shown in FIG. 3, is defined by a plurality of axially spaced spirally extending ribs 38, each pair of which define a groove 39 therebetween. Both the exterior surface 40 and the interior surface 41 thereof are so formed, so as to induce vorticity and consequent mixing of the refrigerant within the tube 34 and of the water which passes along the outside thereof, between it and the interior walls of the tube 23.

In operation, the hot liquid refrigerant which is discharged by the compressor is conveyed through the conduit 14 and upwardly through the conduit 34. As it passes through the conduit 34, it is cooled substantially by the relatively cold water within the tube 23. The warmed water rises through convection upwardly through the open upper end 23*a* of the water tube, and is replaced by relatively cool water which enters at the bottom of that tube from the conduit 24. The refrigerant passes from the tube 34 into the annular chamber 30 surrounding the water tube 23, continuing to warm the water as it descends. It is discharged through the discharge port 31, from whence it is conveyed through the conduit 32 back to the inlet port 13 of the condensor 12 for additional cooling, if it is needed. It will be seen heat will be transmitted from the relatively hot refrigerant to the water in the water tube 23 while it is passing upwardly through the tube 34 and also while it is passing downwardly through the chamber 30 in order to effect a most efficient and complete heat transfer.

The water which is warmed within the heat tube 23 rises to the upper portions of the heat tank 16 and enters the hot water heater 20 whenever permitted to do so as water is drawn from the water heater through the conduit 42, as it is utilized within the household. It will be seen that the hot water is released at the bottom of the hot water heater and, of course, will rise by convection if the surrounding water is at a cooler temperature.

If no water is being drawn by the water heater, the water rising through the tube 23 wll collect, as a result of convection, at the upper area of the tank 16. If no water is drawn over a prolonged period, the cooler water within the tank 16 will descend and will recirculate through the cool water outlet 22 into the conduit 24 and back upwardly through the water tube 23, to be reheated through the heat exchange relationship with the refrigerant in the tube 34.

When water is drawn from the water heater 20, the entire replacement thereof is effected through the supply inlet 19 by the conduit 18 from the storage tank 16. This water is replaced by water that is supplied by the pressurized cold water supply (not shown) through the conduit 26.

It will be seen from the above that we have provided a novel heat-exchanger which is extremely simple in construction and relatively inexpensive to manufacture and install. It will be noted that it has no moving parts and that a refrigerant travels a tortuous and relatively long heat-exchanging path within a very compact and simple structure. Moreover, the configuration of the interior and exterior surfaces of the tube 34 induces vorticity and mixing of the relatively hot refrigerant as it moves upwardly through that tube and at the same time, induces vorticity and mixing within the water which moves upwardly within the tube 23 and around the exterior of the tube 34. The increased vorticity and mixing facilitates the exchange of heat between the refrigerant and the water and, consequently, a more effective heat-exchanging function is accomplished.

It will be readily seen that our novel heat exchanger is very simple to install in that it needs only to be threaded into the bottom wall of the tank 16 and connected by a simple T 25 to the source of water supply and the cold water outlet 22 of the tank. Simple conduits 14, 24 and 32 effect the remaining couplings and thereafter, the unit is installed and ready to operate. Since the compressor will force the hot liquid refrigerant through the line 14 and through the heat exchanger whenever the compressor operates, no additional pumps or other structure is needed to accomplish the heat-exchanging function.

If water is being drawn from the hot water heater, the cold water heating the tube 23 will come from the source through conduit 26, T 25, conduit 24 and into the lower end of the water tube. If water is not being drawn off the hot water heater, the cold water to feed the water tube 23 will come from the lower portion of the storage tank 16 through the cold water outlet 22, to T 25, and the conduit 24. It will be noted that the only water which travels through the tube 23 is that water which is being heated and all other water is exterior thereof, which minimizes the formation of scaling.

The end result of the above function is twofold. First, the storage tank 16 will be supplying approximately 140° water into the hot water heater instead of the colder water, which would otherwise be introduced into the water heater from the normal source of supply. Secondly, the refrigeration system will be provided with an improved cooling system in that its condenser will not have to remove as much heat from the gaseous refrigerant as it is being returned to the compressor. This is particularly important on relatively hot days, or in situations where the condenser is dirty, or proper air movement through the condenser is being restricted for some other reason.

Each of the three tubes 23, 27 and 34 are preferably made of stainless steel, copper or some other suitable material having good heat conducting characteristics.

It will, of course, be understood that various changes may be made in the form, details, arrangement and proportions of the parts without departing from the scope of our invention which consists of the matter shown and described herein and set forth in the appended claims.

We claim:

1. A heat-exchanging system comprising:

(a) a water tank having a cold water outlet adjacent its lower end and a warm water outlet adjacent its upper end;

(b) an upright conduit mounted within said tank and extending upwardly therewithin;

(c) a second conduit of smaller radius than said first mentioned conduit extending upwardly therewithin and being joined together adjacent its upper end in fluid sealed relation and defining an annular fluid chamber having a closer upper end therebetween;

(d) said second mentioned conduit having an open upper end and having a cold water inlet at the lower end portion thereof;

(e) said first mentioned conduit having a fluid discharge port formed therein adjacent its lower end portion and being otherwise closed around said second mentioned conduit;

(f) a third conduit of smaller diameter than said second mentioned conduit and extending upwardly therewithin and being connected in fluid-communicating relation with said fluid chamber adjacent the upper end of the latter;

(g) said third mentioned conduit being constructed and arranged to receive and conduct relatively hot fluid upwardly therethrough in heat-exchanging relationship with a flow of water passing through said chamber in heat-exchange relationship with such water and thence through said discharge port of said first mentioned conduit; and (h) a conduit connecting said cold water outlet of said water tank with said cold water inlet of said second mentioned conduit in free fluid-transmitting relation;

(i) said last mentioned conduit being constructed and arranged to be at all times connected to a pressurized cold water supply in cold-water receiving relation.

2. The structure defined in claim 1 wherein said last mentioned conduit is constructed and arranged to be connected to the pressurized cold water supply at a point adjacent said cold water outlet of said water tank.

3. The structure defined in claim 1 wherein said warm water outlet of said water tank is connected to the water supply inlet of a water heater and provides the entire water supply for the latter.

4. The structure defined in claim 1 wherein said first and second mentioned conduits extends upwardly within said water tank to an elevation adjacent the top of the latter.

5. The structure defined in claim 1 wherein said second mentioned conduit extends upwardly from the bottom of said water tank to an elevation adjacent the top of the latter.

6. The structure defined in claim 1 wherein said third mentioned conduit has an interior fluid conducting surface which is irregular in contour.

7. The structure defined in claim 1 wherein said third mentioned conduit has an interior fluid conducting surface characterized by a plurality of axially spaced spirally arranged ribs, each adjacent pair of which are separated by a spirally arranged groove.

8. The structure defined in claim 1 wherein said third mentioned conduit has interior and exterior surfaces each of which is characterized by a plurality of axially spaced spirally arranged ribs each adjacent pair of which defines a spirally arranged groove therebetween.

* * * * *